United States Patent [19]

Muad

[11] Patent Number: 4,512,698

[45] Date of Patent: Apr. 23, 1985

[54] HOLDING MECHANISM, IN PARTICULAR FOR SKI BINDINGS

[75] Inventor: Al-Madhi Muad, Vienna, Austria

[73] Assignee: TMC Corporation, Baar, Switzerland

[21] Appl. No.: 465,121

[22] Filed: Feb. 9, 1983

[30] Foreign Application Priority Data

Feb. 12, 1982 [AT] Austria ..... 548/82

[51] Int. Cl.[3] ..... F16B 21/00; F16B 37/00

[52] U.S. Cl. ..... 411/337; 411/436; 411/437

[58] Field of Search ..... 411/337, 347, 349, 436, 411/437

[56] References Cited

U.S. PATENT DOCUMENTS

| | | | |
|---|---|---|---|
| 1,927,780 | 9/1933 | Anderson | 411/337 X |
| 2,818,764 | 1/1958 | Switzer | 411/437 |
| 2,917,966 | 12/1959 | Kahn | 411/437 |
| 4,367,995 | 1/1983 | Mizusawa et al. | 411/437 X |

FOREIGN PATENT DOCUMENTS

| | | | |
|---|---|---|---|
| 157520 | 7/1954 | Australia | 411/337 |
| 1207154 | 12/1965 | Fed. Rep. of Germany | 411/337 |
| 685965 | 4/1930 | France | 411/437 |
| 1466538 | 12/1966 | France | 411/337 |
| 46-5649 | 6/1971 | Japan | 411/337 |
| 232671 | 4/1969 | U.S.S.R. | 411/337 |

*Primary Examiner*—Thomas J. Holko

*Attorney, Agent, or Firm*—Flynn, Thiel, Boutell & Tanis

[57] ABSTRACT

A base member of a ski binding has vertical bores therethrough, and fastening screws which extend through the bores secure the ski binding to the top surface of a ski. Each bore has two vertically spaced, inwardly projecting shoulders which extend generally parallel to the top surface of the ski. Viewed from the top, each shoulder is delimited by two circles of different radius, the larger radius being equal to the radius of the bore. The two circles intersect tangentially at a point opposite the center of the shoulder, and the contact points of the circles of the respective shoulders are angularly offset by 180° with respect to each other.

2 Claims, 3 Drawing Figures

HOLDING MECHANISM, IN PARTICULAR FOR SKI BINDINGS

FIELD OF THE INVENTION

The invention relates to a base member of a ski binding, and in particular to a base member having at least one bore for a fastening screw, wherein the wall of the bore, for holding the inserted fastening screw, has shoulders which both along the periphery of the bore and also in a vertical direction are offset relative to one another.

BACKGROUND OF THE INVENTION

A base member of the above-mentioned type is known, for example the base plate of a ski binding which is available on the market. In this base plate, three shoulders are provided in each individual bore, serve to hold an inserted fastening screw, and are designed along a course of the thread. The surface of each shoulder extends thereby in the direction of the course of the thread and thus has an inclination corresponding to the pitch of the thread, which assures a satisfactory holding of the individual fastening screws. The disadvantage of shoulders which are constructed in this manner is that an apparatus with special tools must be used for the manufacture of suitable thread sections. For a secure hold of the fastening screws in this holding arrangement, the use of three shoulders is absolutely necessary, which in turn requires the use of three tools. The three tools must in addition be eroded in order to be able to manufacture the necessary surface of the individual shoulders, which surface corresponds with the pitch of the thread. Furthermore, the soconstructed shoulders can easily be damaged, which endangers the secure hold and thus the vertical position of the individual fastening screws. This has the result that, due to the installation, the screws are in a position with respect to the upper side of the ski which differs from the vertical, through which a goal of the invention is no longer achieved. This goal is that a secure fastening of the base plate of a ski binding without any further manipulation only by screwing the fastening screw into the mounting, namely into the ski, is to be able to take place.

A purpose of the invention is to provide a base member of the above-mentioned type with bores designed so that the number of shoulders is reduced and their ability to hold and center the individual fastening screws prior to their use is improved, as compared with the conventional solution, whereby the stability of the shoulders which are used is supposed to be increased and their design is supposed to be simplified.

SUMMARY OF THE INVENTION

This purpose is attained inventively by providing two shoulders and each such shoulder, viewed in a top view, being delimited by two circles of different radius, the larger radius corresponding to the radius of the bore. These two circles tangentially contact one another at a contact point and the two contact points of the circles for the respective shoulders are offset by 180° relative to one another.

Through the inventive development of the shoulders, the use of two shoulders is sufficient to hold the fastening screws in the individual bores in the desired position, the individual shoulders of each bore being angularly offset by 180° relative to one another.

The effect which results thereby is surprising, in as far as it was expected by the technical world that two shoulders would not be sufficient for achieving the set goal. In particular, it was believed that the set goal could not be achieved by using shoulders which do not have a design which corresponds with the inclined course of the thread of the individual fastening screws.

A particularly advantageous embodiment of the invention involves the individual shoulders being offset vertically by a (full) course or turn of the thread of the fastening screw which is being used. Through this, a secure hold of the fastening screws in the individual bores is assured without any undesired deformation of the shoulders taking place.

BRIEF DESCRIPTION OF THE DRAWINGS

Further characteristics, advantages and details of the invention are described in connection with the drawing, which illustrates one exemplary embodiment of a base member of a safety ski binding.

In the drawing.

DETAILED DESCRIPTION

Figure 3:
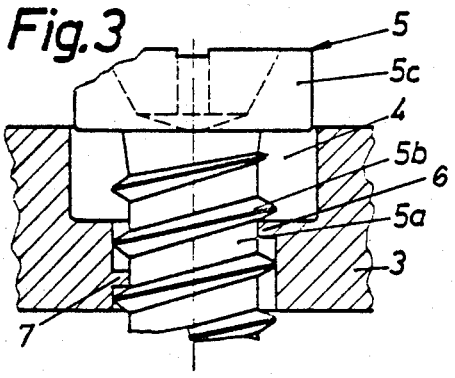
FIG. 3 is a view similar to FIG. 2 showing a fastening screw disposed in the bore.

A jaw member of a ski binding is identified as a whole with reference numeral 1 (FIG. 1) and is secured on the upper side of a ski 2 by means of a base member 3. The housing of the jaw member 1 is preferably constructed in one piece with the base member 3. For fastening the base member 3 on the upper side of the ski 2, fastening screws 5 are utilized, one of which is illustrated in FIG. 3 in one of the several vertical bores 4 provided through the base member 3.

Figure 1:
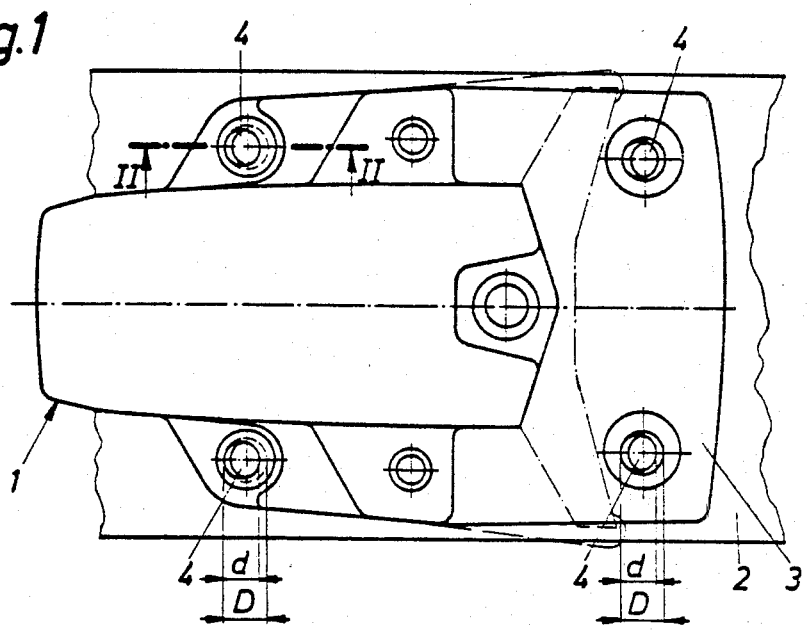
FIG. 1 is a top view of a base member of a jaw of a ski binding embodying the invention.

As one can see from FIG. 1, four bores 4 are provided for fastening the base member 3 on the upper side of the ski 2. Two shoulders 6 and 7 are constructed in each of the individual bores 4. The shoulders 6 and 7 are spaced vertically from one another and are angularly offset by 180° relative to one another in the bores 4, as one can see in FIG. 1. The distance between the two shoulders 6 and 7 of the bore 4 is one (full) course or turn of the thread, as can be seen from FIG. 3 in connection with a fastening screw 5. This means that the two shoulders 6 and 7, without any kind of slope of their upper sides or undersides with respect to the upper side of the ski 2, form a secure hold for the individual fastening screws 5. The distance just mentioned between the shoulders 6 and 7 is either the distance between the undersides thereof or the distance between the upper sides thereof. As the shoulders 6 and 7 are angularly offset by 180° relative to one another, the shoulder 6 engages the underside of the thread at the base thereof and the shoulder 7 engages the other side of the thread at the base thereof. It is obvious that the distance between the two shoulders 6 and 7 depends on the pitch of the screw thread. The axial thickness of the shoulders 6 and 7 should be small, so that the fastening screw can be easily screwed in. Each shoulder 6 and 7 of the individual bores 4 thereby has, viewed in the top view, a special design which will now be discussed in detail.

Each shoulder 6 and 7 is, viewed in the top view, delimited by two circles which have different diameters D and d. The larger diameter D is equal to the diameter of the bore 4. The two circles which thus delimit a shoulder 6 or 7 contact each other tangentially at a point which is necessarily diametrically opposite the center of the shoulder. The two contact points of the respective pairs of circles defining the respective shoulders 6 and 7 are offset relative to one another by 180°.

The particular design of the individual shoulders 6 and 7 of the bores 4 permits the upper and lower surfaces of the shoulders 6 and 7 to be maintained parallel to the upper side of the ski 2 without causing the inserted fastening screws 5 to be pushed away from their position normal to the upper side of the ski 2. The two shoulders 6 and 7 thus embrace a section of the shank 5*a* of the screw 5 between axially adjacent portions of the thread 5*b*, without which, during the turning in of the screw before or during the installation, damage to the individual shoulders 6 and 7 would be experienced. Of course, attention must thereby be paid to the fact that in each case only fastening screws 5 which have a thread 5*b* for which the shoulders 6 and 7 are designed should be used.

Figure 2:
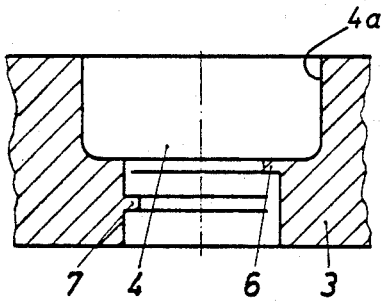
FIG. 2 is a sectional view taken along the line II—II of FIG. 1 and shows a bore in the base member.

A receiving recess 4*a* for receiving the head of the fastening screw 5 is provided and can, depending on the shape of the screw head, have a shape which differs from that illustrated in FIG. 2.

The invention is not limited to the illustrated exemplary embodiments. Further variations or modifications are possible, including the rearrangement of parts, which by all means lie within the scope of protection. Thus, it is unimportant whether the housing is constructed in one piece with the base member or is secured thereon in a conventional manner, for example by rivets. Also, the materials selected for the jaw, its housing, the base member and the fastening screws are left to the judgment of the designer, as required by the particular circumstances.

The embodiments of the invention in which an exclusive property or privilege is claimed are defined as follows:

1. In a base member having a generally cylindrical bore for receiving a fastening screw, wherein the surface of the bore, for holding the fastening screw, has two shoulders which are offset circumferentially and axially in said bore relative to one another, the improvement comprising wherein each said shoulder, viewed in an axial direction, is defined by two nested circles of different radius, the larger radius being equal to the radius of said bore and the circles contacting one another substantially tangentially at a contact point, and wherein the contact points of the circles of the respective shoulder are angularly offset by 180° relative to one another.

2. The base member according to claim 1, wherein the individual shoulders are offset axially by a distance which is equal to one full turn of the thread of the fastening screw.

* * * * *

UNITED STATES PATENT AND TRADEMARK OFFICE

CERTIFICATE OF CORRECTION

PATENT NO. : 4 512 698

DATED : April 23, 1985

INVENTOR(S) : Al-Madhi MUAD

It is certified that error appears in the above-identified patent and that said Letters Patent is hereby corrected as shown below:

Column 4, line 23; change "shoulder" to ---shoulders---.

Signed and Sealed this

*Eighth* Day of *October 1985*

[SEAL]

*Attest:*

DONALD J. QUIGG

*Attesting Officer*

*Commissioner of Patents and Trademarks—Designate*